US006837044B2

(12) United States Patent
Kobayashi et al.

(10) Patent No.: US 6,837,044 B2
(45) Date of Patent: Jan. 4, 2005

(54) STRUCTURE OF AN EXHAUST MANIFOLD BRANCH COLLECTING PORTION

(75) Inventors: Naoyuki Kobayashi, Hiroshima (JP); Yasuhiko Fukumoto, Hiroshima (JP); Katsumi Tateiwa, Hiroshima (JP); Teruhiko Nishihara, Hiroshima (JP); Kazuya Tominaga, Hiroshima (JP)

(73) Assignee: Yumex Corporation, Hiroshima (JP)

( * ) Notice: Subject to any disclaimer, the term of this patent is extended or adjusted under 35 U.S.C. 154(b) by 0 days.

(21) Appl. No.: 10/385,835

(22) Filed: Mar. 12, 2003

(65) Prior Publication Data

US 2003/0172648 A1 Sep. 18, 2003

(30) Foreign Application Priority Data

Mar. 13, 2002 (JP) ..... 2002-067765

(51) Int. Cl.[7] ..... F01N 7/10
(52) U.S. Cl. ..... 60/323; 60/324
(58) Field of Search ..... 60/323, 321, 324, 60/305; 29/890.08

(56) References Cited

U.S. PATENT DOCUMENTS

| | | | | | |
|---|---|---|---|---|---|
| 4,289,170 | A | * | 9/1981 | Pape | 138/117 |
| 4,373,329 | A | * | 2/1983 | Martini | 60/305 |
| 5,727,386 | A | * | 3/1998 | Watanabe et al. | 60/323 |
| 6,122,911 | A | * | 9/2000 | Maeda et al. | 60/323 |
| 6,557,343 | B2 | * | 5/2003 | Furudate | 60/324 |
| 6,625,979 | B2 | * | 9/2003 | Sugaya et al. | 60/323 |

FOREIGN PATENT DOCUMENTS

| | | | | |
|---|---|---|---|---|
| JP | 64-12021 | * | 1/1989 | |
| JP | 08-334020 | | 12/1996 | |
| JP | 2003-83062 | | 3/2003 | |
| JP | 2003083062 A | * | 3/2003 | F01N/7/18 |

* cited by examiner

*Primary Examiner*—Tu M. Nguyen
(74) *Attorney, Agent, or Firm*—Armstrong, Kratz, Quintos, Hanson & Brooks, LLP

(57) ABSTRACT

A structure of an exhaust manifold branch collecting portion where a plurality of pipe members are joined integrally at their respective downstream ends, wherein a thickened portion is provided at the downstream end of at least one pipe member on a center side of the exhaust manifold branch collecting portion.

9 Claims, 6 Drawing Sheets

STRUCTURE OF AN EXHAUST MANIFOLD BRANCH COLLECTING PORTION

BACKGROUND OF THE INVENTION

FIELD OF THE INVENTION

The present invention relates to an exhaust manifold as an exhaust device for use with a multi-cylinder internal combustion engine, and more particularly to a structure of an exhaust manifold branch collecting portion where a plurality of pipe members are joined.

A structure of an exhaust manifold branch collecting portion is disclosed in, for example, Japanese Laid-open Patent Application No. 8-334020, wherein a plurality of pipe members extending from a multi-cylinder engine are joined at their respective downstream end portions around the center line of a collecting pipe.

However, in this conventional exhaust manifold branch collecting portion, if the length of each pipe member differs by about 1.5 times between the longest and shortest pipe members, the collecting portion of these pipe members is subject to stress concentration at its center due to differences of the heat deformation, leading to cracking and leakage of exhaust gas. This is particularly serious when a reinforcement plate is provided between pipe members.

For this reason, various countermeasures have been taken, such as decreasing the difference of each pipe length, upgrading the material of the pipe members, and applying a patch. However, these create another drawback, such as increased layout space requirement, or increment of the cost due to increased number of parts.

In view of the above, the present invention seeks to provide a structure of an exhaust manifold branch collecting portion which does not increase the number of parts and which relieves the stress concentration at the center of the collecting portion to thereby prevent occurrence of cracking.

SUMMARY OF THE INVENTION

According to the present invention, there is provided a structure of an exhaust manifold branch collecting portion where a plurality of pipe members are joined integrally at their respective downstream ends, wherein a thickened portion is provided at the downstream end of at least one pipe member on a center side of the exhaust manifold branch collecting portion.

In one preferred embodiment, the thickened portion is formed by overlaying.

In another preferred embodiment, the thickened portion is formed by plastic deformation.

In still another preferred embodiment, the thickened portion is formed by folding back the downstream end of the pipe member.

In a further preferred embodiment, the thickened portion is formed by a ring member that is fixed to a peripheral surface defined by the downstream end of the pipe member.

In a still further preferred embodiment, the thickened portion is formed by a ring member that is fixed to a peripheral terminal end surface defined by the downstream end of the pipe member, and wherein the ring member has a greater thickness than the pipe member.

In another preferred embodiment, the plurality of pipe members are joined integrally at their respective downstream ends by welding each downstream end at a space extending between the pipe members and along a center line of the exhaust manifold branch collecting portion.

In a further preferred embodiment, the ring member is formed by a material with a greater heat resisting strength than the pipe member.

According to the present invention, a thickened portion is provided on the inner wall of the pipe member at the center side of the exhaust manifold branch collecting portion. As a result, a thick area made by the thickness of the pipe member and the thickness of the thickened portion is formed to release the stress concentration due to differences of heat deformation. This prevents occurrence of cracking at the center of the exhaust manifold branch collecting portion without increasing the number of parts.

BRIEF DESCRIPTION OF THE DRAWINGS

Preferred embodiments of the present invention will be described below, by way of example only, with reference to the accompanying drawings, in which.

DESCRIPTION OF THE PREFERRED EMBODIMENTS

A structure of an exhaust manifold branch collecting portion according to the present invention will be described in detail with reference to the accompanying drawings.

Figure 1:
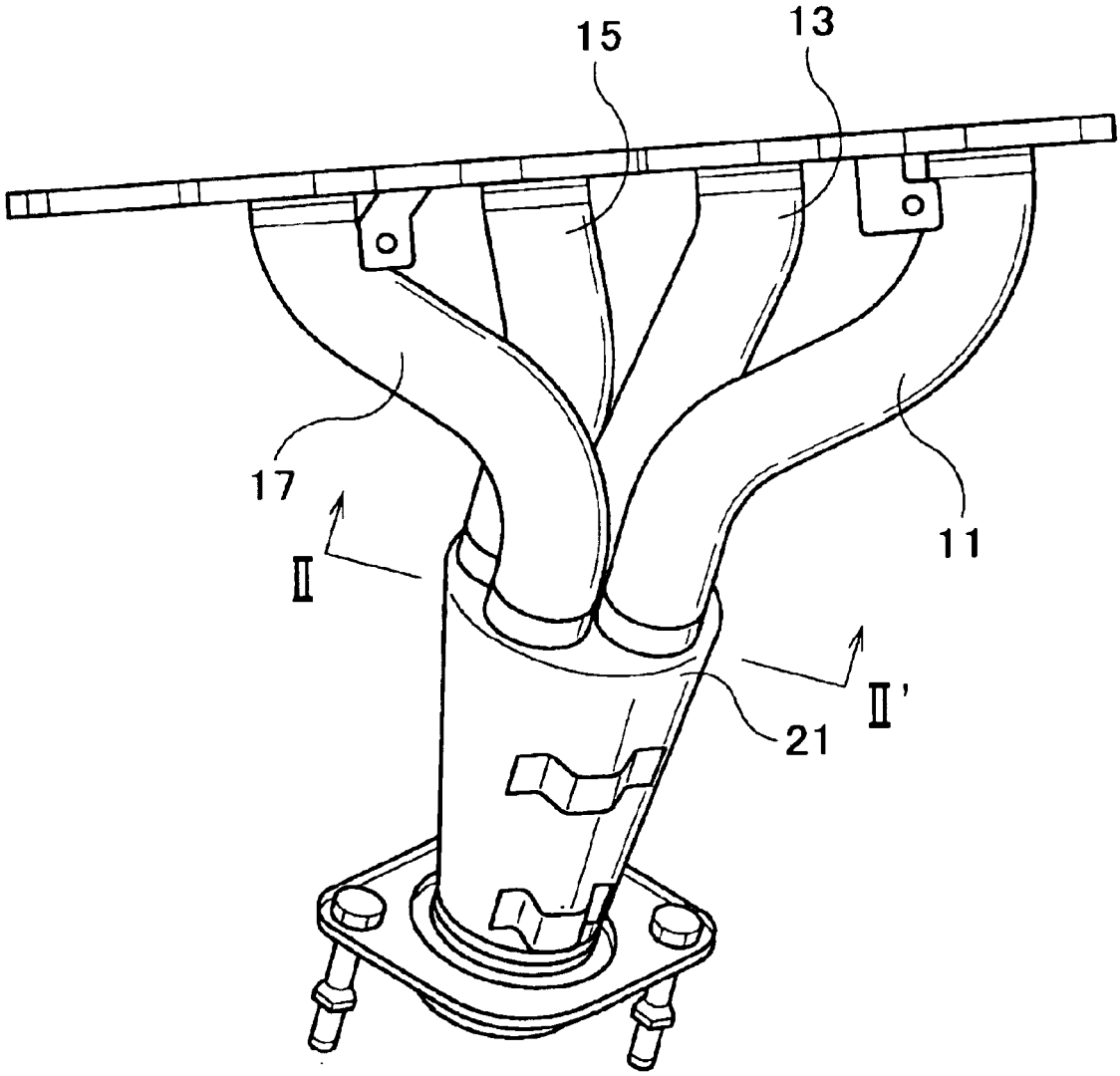
FIG. 1 is a perspective view of a structure of an exhaust manifold branch collecting portion according to the invention.
Figure 2:
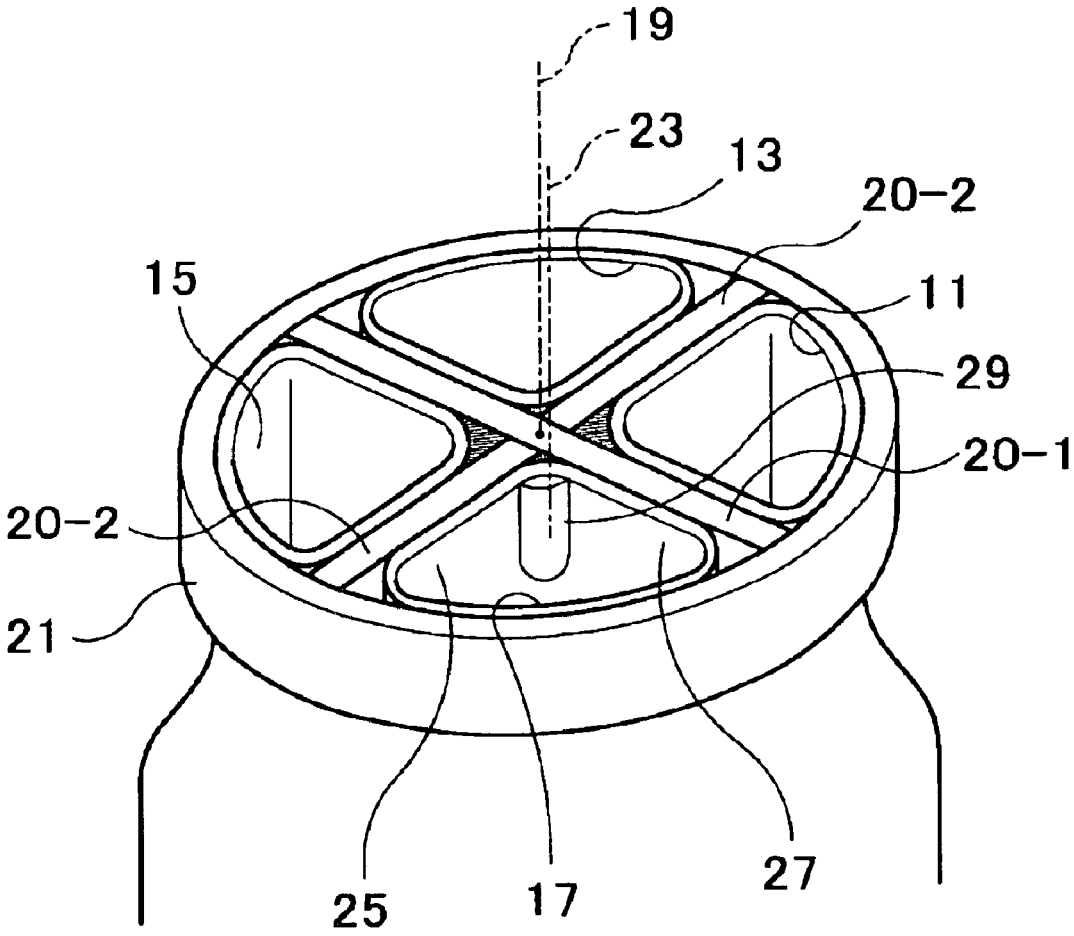
FIG. 2 is a perspective view taken along the line II-II' of FIG. 1 and viewing from bottom.
Figure 3:
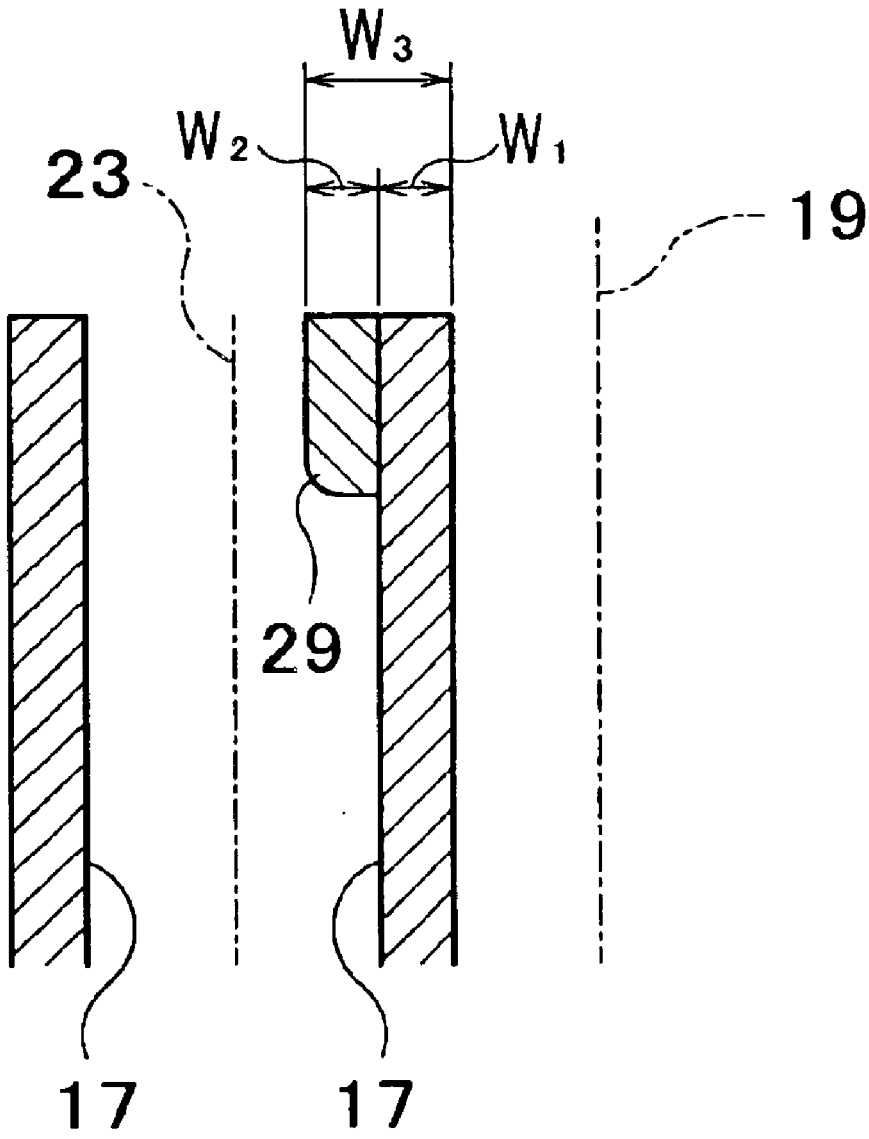
FIG. 3 is a sectional view showing one preferred embodiment of a thickened portion formed on a pipe member.

As shown in FIGS. 1 through 3, an exhaust manifold branch collecting portion includes a unit structure of four pipe members 11, 13, 15 and 17 wherein the pipe members 11, 13, 15 and 17 are welded at their respective downstream ends against a partition wall 20-1 and reinforcement walls 20-2, 20-2 that are assembled perpendicularly to the partition wall 20-1 around a center line 19, and a collecting pipe 21 partly accommodating the unit structure. At the downstream end of the unit structure to be positioned within the collecting pipe 21, each pipe member 11, 13, 15 and 17 has inner walls 25, 27 extending along an axial line 23 that is in parallel relation to the center line 19. A thickened portion 29 is provided at a boundary of the pipe member 17 between the inner walls 25, 27 where the greatest thermal stress is applied due to differences of heat deformation. Although only one thickened portion 29 is provided in this preferred embodiment, the present invention is not limited to this particular embodiment. For example, each of the other pipe members 11, 13 and 15 may be provided with a thickened portion.

More specifically, with the use of an MIG (Metal Inert Gas Arc Welding) device and the like, the downstream ends of the pipe members 11, 13, 15 and 17 are seal-welded such that the partition wall 20-1 and the reinforcement walls 20-2, 20-2 are interposed therebetween in a crisscross manner, and at the same time, the thickened portion 29 is formed from the downstream side to the upstream side of the pipe member 17 by means of MIG or TIG (Tungsten Inert Gas Arc Welding) method.

The thickened portion 29 shown in FIGS. 2 and 3 may be formed by overlaying so that a deposited metal piece is formed on the pipe member 17. As shown in FIG. 3, the thickened portion 29 thus formed has a thick area W3 made by the thickness W1 of the pipe member and the thickness W2 of the thickened portion 29 to release the stress concentration. Preferably, niobium is added in the deposited metal piece. Repeated experimental results indicate that such a niobium-containing deposited metal piece expresses improved heat resistance and excellent performance against heat deformation.

Figure 4A:
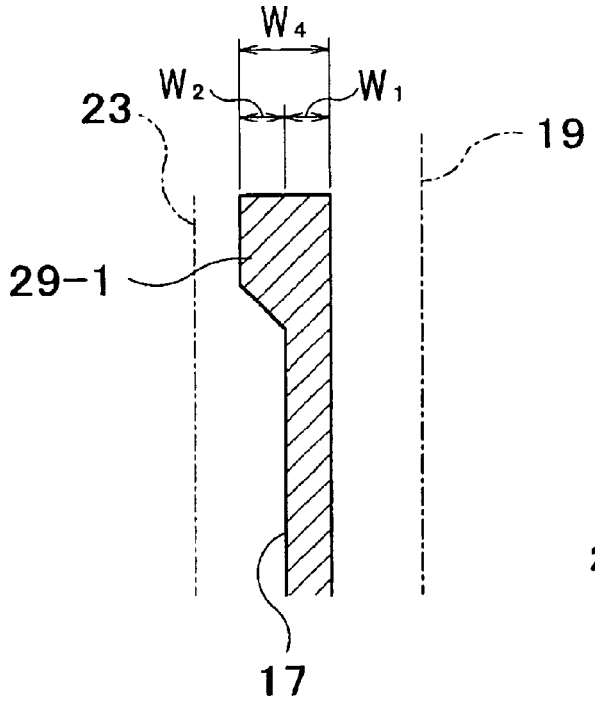
FIG. 4A is a sectional view showing a modification of the thickened portion formed on the pipe member.
Figure 4B:
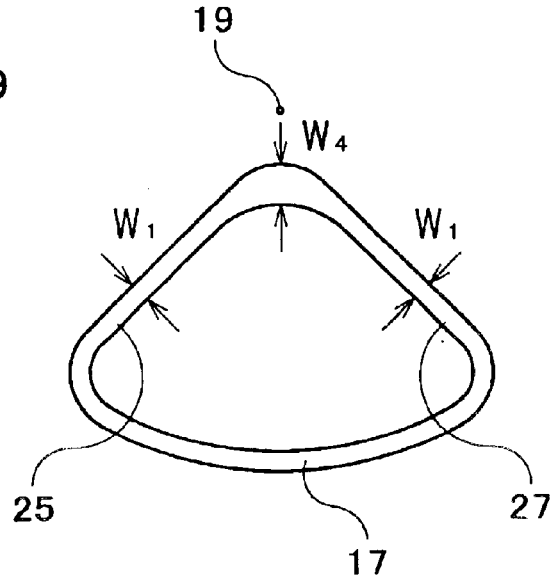
FIG. 4B is a sectional view taken in the radial direction of the pipe member shown in FIG. 4A.

The thickened portion 29 may be formed by various methods as described below. A thickened portion 29-1 shown in FIGS. 4A and 4B is formed by plastic deformation. The thickened portion 29-1 is formed as the downstream end of the pipe member 17. The thickness W of the thickened portion 29-1 changes gradually from the thickness W4 at the apex adjacent to the center line 19 to the thickness W1 of the inner walls 25, 27 of the pipe member 17. The whole pipe member is formed with use of a die, punch or a press machine, and the like, so that the thickness W2 of the thickened portion 29-1 is added inward of the thickness W1 of the pipe member 17 to provide the thickness W4. Alternatively, the thickness W2 of the thickened portion 29-1 may be added outward of the thickness WI of the pipe member 17 to provide the thickness W4.

Figure 5:
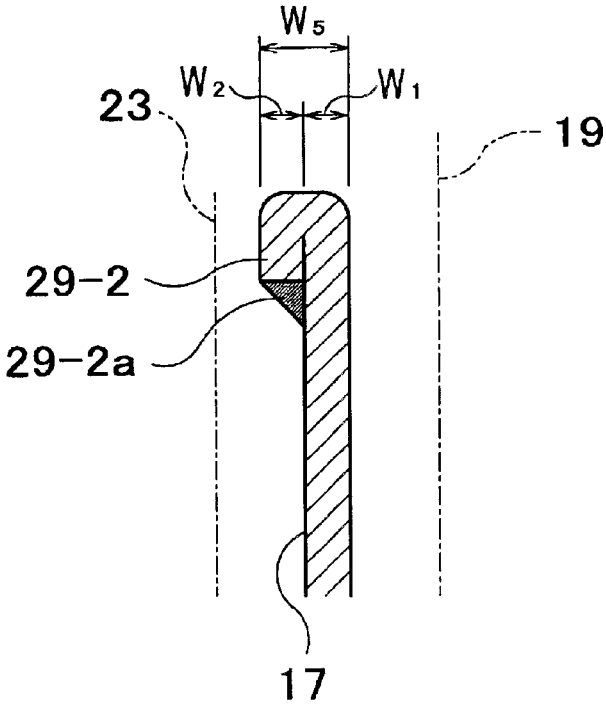
FIG. 5 is a sectional view showing another modification of the thickened portion formed on the pipe member.

A thickened portion 29-2 shown in FIG. 5 is formed by folding back the bottom edge of the downstream end of the pipe member 17 inwardly, followed by welding to form a weld portion 29-2*a*, so that a thick area W5 that is twice as thick as the thickness W1 of the pipe member 17 (i.e., W5 W1+W1=2W1) is formed. Alternatively, the thickened portion 29-2 with the thickness W1 of the pipe member 17 may be formed by folding back the bottom edge of the downstream end of the pipe member 17 outwardly.

Figure 6:
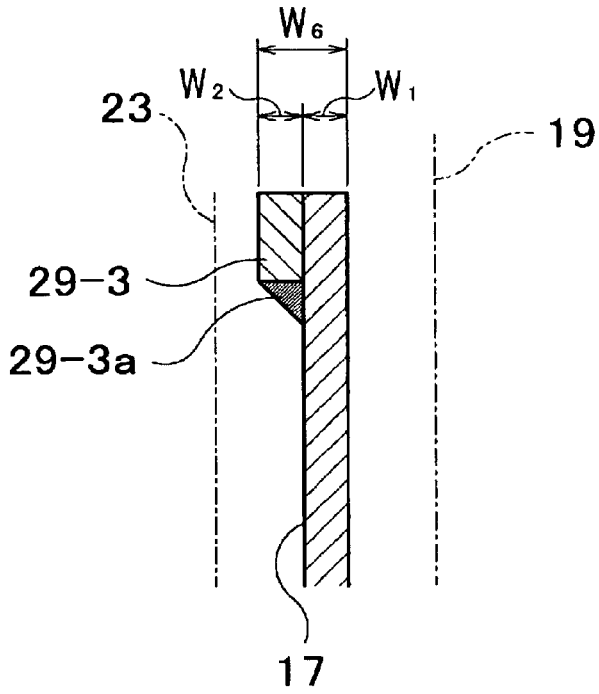
FIG. 6 is a sectional view showing still another modification of the thickened portion formed on the pipe member.

A thickened portion shown in FIG. 6 is formed by fitting a ring member 29-3 with the thickness W2 into an inner peripheral surface defined by the downstream end of the pipe member 17 to cover the inner peripheral surface, followed by welding to form a weld portion 29-3*a*, so that a thick area W6 that is made by the thickness W1 of the pipe member 17 and the thickness W2 of the ring member 29-3 is formed. Alternatively, the ring member 29-3 may be fitted onto an outer peripheral surface defined by the downstream end of the pipe member 17. The ring member 29-3 may be formed by a material with a greater heat resisting strength than the pipe member 17.

Figure 7:
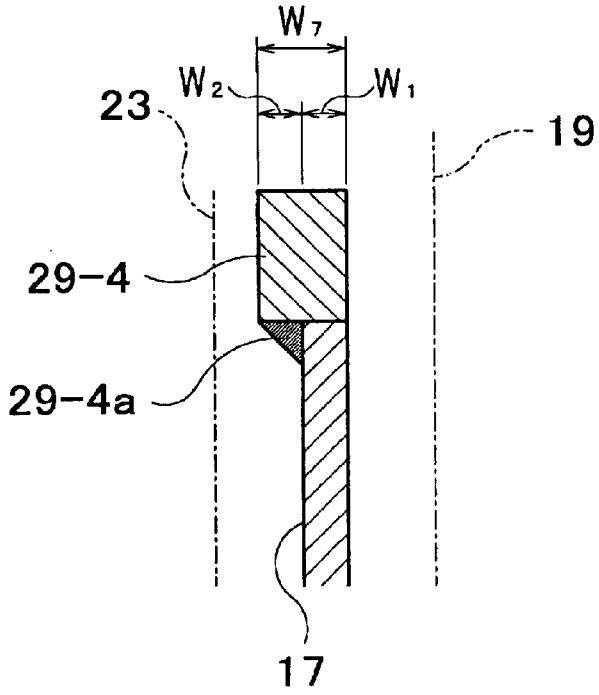
FIG. 7 is a sectional view showing a further modification of the thickened portion formed on the pipe member.

A thickened portion 29 shown in FIG. 7 is formed by a thickened ring member 29-4 with the thickness W7 that is fixed to a peripheral terminal end surface defined by the downstream end of the pipe member 17 and extends longitudinally from the peripheral terminal end surface. The thickened ring member 29-4 is fixed to the pipe member 17 at a weld portion 29-4*a*. The thickness W7 of the thickened ring member 29-4 is the total of the thickness W1 of the pipe member 17 and the thickness W2. The thickened ring member 29-4 may be formed by a material with a greater heat resisting strength than the pipe member 17.

Figure 8:
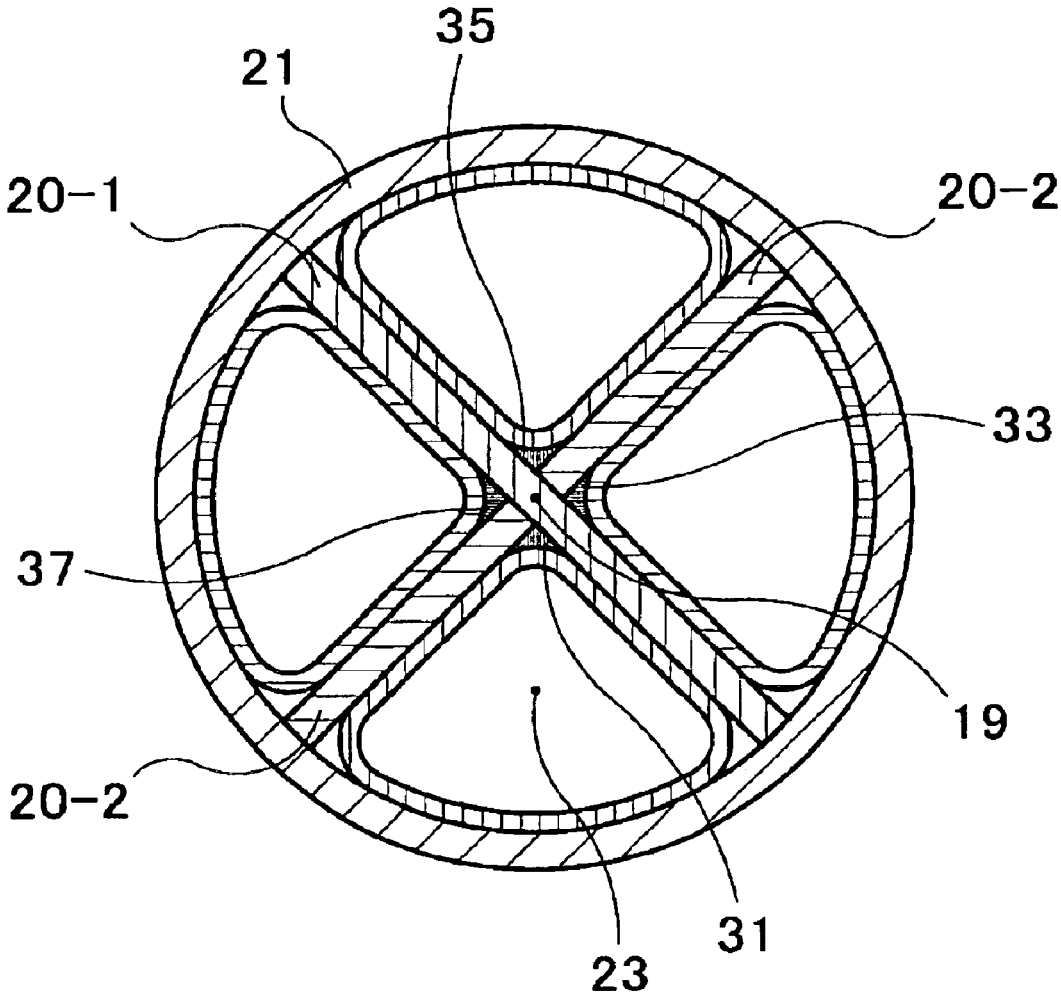
FIG. 8 is a sectional view showing another preferred embodiment of a thickened portion formed on the pipe member, as being taken along the line II-II' of FIG. 1.

In the example shown in FIG. 8, a weld portion 31, 33, 35 and 37 is formed in a space surrounded by each pipe member 11, 13, 15 and 17, the partition wall 20-1, and the reinforcement walls 20-2, 20-2.

As previously described, the partition wall 20-1 and the reinforcement walls 20-2, 20-2 are seal-welded, and thereafter a thickened portion 29 is formed by means of welding on the center side of the exhaust manifold branch collecting portion at the boundary of the inner walls 25, 27 and along the axial line 23, so that the stress due to differences of heat deformation is divided. According to the simulation result of the stress test at the center part of the exhaust manifold branch collecting portion, the stress concentration toward the center part can be alleviated by 20%. As the result, occurrence of cracking can be prevented. This can be readily realized without requiring an introduction of advanced technology, novel equipment and the like, which leads to reduction of the production cost.

While the present invention has been described in detail with reference to specific embodiment thereof, it will be apparent to one skilled in the art that various changes and modifications may be made without departing from the scope of the claims. For example, the collecting pipe 21 has a circular cross section in the preferred embodiments, however, the collecting pipe 21 may have a square cross section. Also, the ring member 29-3 may be formed by a material that is different from the pipe member.

Further, instead of the thickened portion 29 that is formed inward of the pipe member, the thickened portion 29 may be formed outward of the pipe member. This is advantageous because provision of the thickened portion 29 does not result in increased flow resistance of the exhaust gas.

What is claimed is:

1. A structure of an exhaust manifold branch collecting portion where a plurality of pipe members are joined integrally at their respective downstream ends, wherein a thickened portion is provided at the downstream end of at least one pipe member on a center side of the exhaust manifold branch collecting portion, wherein said thickened portion extends in an axial direction along a boundary between two inner walls of said at least one pipe member.

2. A structure of an exhaust manifold branch collecting portion according to claim 1, wherein said thickened portion is formed by overlaying.

3. A structure of an exhaust manifold branch collecting portion according to claim 1, wherein said thickened portion is formed by plastic deformation.

4. A structure of an exhaust manifold branch collecting portion according to claim 1, wherein said thickened portion is formed by folding back the downstream end of the pipe member.

5. A structure of an exhaust manifold branch collecting portion according to claim 1, wherein said plurality of pipe members are joined integrally at their respective downstream ends by welding each downstream end at a space extending between the pipe members and along a center line of the exhaust manifold branch collecting portion.

6. A structure of an exhaust manifold branch collecting portion according to claim 1, wherein said thickened portion is formed by a ring member that is fixed to a peripheral surface defined by the downstream end of the pipe member.

7. A structure of an exhaust manifold branch collecting portion according to claim 6, wherein said ring member is formed by a material with a greater heat resisting strength than the pipe member.

8. A structure of an exhaust manifold branch collecting portion according to claim 1, wherein said thickened portion is formed by a ring member that is fixed to a peripheral terminal end surface defined by the downstream end of the pipe member, and wherein the ring member has a greater thickness than the pipe member.

9. A structure of an exhaust manifold branch collecting portion according to claim 8, wherein said ring member is formed by a material with a greater heat resisting strength than the pipe member.

* * * * *